United States Patent [19]

Banzhaf et al.

[11] 4,031,873

[45] June 28, 1977

[54] FUEL INJECTION SYSTEM FOR INTERNAL COMBUSTION ENGINES HAVING CONTROLLED EXHAUST GAS RECYCLING

[75] Inventors: Werner Banzhaf, Sindelfingen; Gerhard Stumpp, Stuttgart-Vaihingen; Gerhard Schielinsky, Schwaikheim, all of Germany

[73] Assignee: Robert Bosch G.m.b.H., Stuttgart, Germany

[22] Filed: June 30, 1976

[21] Appl. No.: 701,160

[30] Foreign Application Priority Data

July 10, 1975 Germany ..... 2530777

[52] U.S. Cl. ..... 123/119 A; 123/139 AW; 123/139 BG

[51] Int. Cl.[2] ..... F02M 25/06; F02M 7/00; F02B 31/00

[58] Field of Search ... 123/119 A, 139 AW, 139 BG, 123/139 R

[56] References Cited

UNITED STATES PATENTS

| | | | |
|---|---|---|---|
| 3,105,478 | 10/1963 | Lyon | 123/139 BG |
| 3,777,725 | 12/1973 | Stump et al. | 123/139 AW |
| 3,954,091 | 5/1976 | Stump | 123/119 A |
| 3,983,849 | 10/1976 | Stump | 123/139 AW |

FOREIGN PATENTS OR APPLICATIONS

| | | | |
|---|---|---|---|
| 1,180,241 | 12/1958 | France | 123/139 BG |

*Primary Examiner*—Wendell E. Burns
*Attorney, Agent, or Firm*—Edwin E. Greigg

[57] ABSTRACT

What follows is a description of various exemplary embodiments of a fuel injection system for an internal combustion engine with exhaust gas recycling controlled by a throttle valve situated in the suction tube of the system. The throttle valve is in turn controlled by a servomotor having a displaceable piston connected to the throttle valve. The piston is displaceable against a variable restoring force exerted against it and produces displacements of the throttle valve between two positions, one corresponding to a fully opened position of the throttle valve and closed exhaust gas recycling line, and the other corresponding to a substantially closed throttle valve.

16 Claims, 4 Drawing Figures

FUEL INJECTION SYSTEM FOR INTERNAL COMBUSTION ENGINES HAVING CONTROLLED EXHAUST GAS RECYCLING

BACKGROUND OF THE INVENTION

The present invention relates to a fuel injection system for an internal combustion engine.

A particularly effective method for reducing the toxic components in the exhaust gas of an internal combustion engine consists in recycling specific quantities of exhaust gas according to the particular operating state of the engine. A reduction in the amount of nitrogen oxide in the exhaust gas is achieved by means of this method. However, as this reduction in the nitrogen oxides in the exhaust gas is known to be accompanied by an increase in the amounts of soot, CO and HC in the exhaust gas, it is necessary to strictly regulate the exhaust gas recycling rate, the quantity of fresh air supplied and the quantity of fuel injected so as to obtain an optimum air excess over the entire load range of the engine. At low speeds, and particularly during idling, the performance of the engine is adversely affected by excessive exhaust gas recycling rates.

One fuel injection system proposing exhaust gas recycling is disclosed in German OS (laid open patent application) No. 2,321,970. This patent application describes a fuel injection system for diesel engines wherein an exhaust gas quantity which has been adapted to the quantities of fuel injection or to the particular engine load which has been engaged, is recycling to the suction side of the engine. In this case, a specific fuel-air mixture can be supplied to the engine in that the fresh air which is sucked in and the quantity of fuel injection are constantly regulated in dependence on one another by means of an air metering device and a fuel metering device. A reduction in the $NO_x$ components in the exhaust gas is obtained by regulated exhaust gas recycling.

Another proposed system includes a suction tube and a throttle valve disposed in the suction tube upstream of the mouth of an exhaust gas recycling line discharging into the suction pipe for controlling the exhaust gas return flow. Also induced are an air metering element measuring the quantity of fresh air down into the suction tube and a fuel injection device whose arbitrarily variable delivery constitutes a reference parameter for a regulating device controlling the throttle valve by means of a hydraulic servomotor. The fuel suction line of the injection device contains an uncontrolled pressure chamber of a differential pressure valve and upstream thereof a throttle cross-section which is variable by means of a control plunger displaceable by means of the air metering element in opposition to a regulatable essentially constant hydraulic restoring force. The controlled outflow opening of the pressure chamber of the differential pressure valve, which is exposed to a substantially constant reference pressure, is in communication with the working chamber of the servomotor.

OBJECTS AND SUMMARY OF THE INVENTION

It is a principle object of the present invention to improve these systems so as to further reduce the toxic components in the exhaust gases and to accurately adapt the fuel-air mixture to the requirements of the engine while producing a low-fume, minimum toxicity operation without substantially affecting the capacity of the engine or damaging the action of the engine.

This object and others are achieved according to the present invention by the provision of a servomotor having a piston displaceable in opposition to a variable restoring force corresponding to a variation of the throttle valve from a completely open position with a closed exhaust gas recycling line, to an almost closed position, with the closed position being determined by an adjustable stop. In this manner the fuel-air mixture can be optimally adapted to the particular engine at different loads.

A specific advantage of this arrangement is that during the first stroke of the engine during acceleration from zero load a continuously supplied minimum quantity of fresh air is drawn in via the exhaust gas recycling line as well as exhaust gas. A burst of smoke would be produced if exhaust gas alone were drawn in during this period.

According to an advantageous feature of the present invention, the restoring force is provided by a pressure spring arrangement consisting of at least one pressure spring having a defined force curve or a variable, constant hydraulic pressure. In this way it is possible to obtain a load-dependent rectification or, if necessary, a fuel-air mixture which is independent of the throttle valve position.

During full load operation the fuel-air mixture is generally determined by the injection quantity characteristic of the injection pump as a function of the pump rate. According to the present invention, a further measure for optimally adapting the fuel-air mixture during full load consists in that a connection, which is equipped with a first throttle and which leads from the working chamber of the servomotor to a working chamber which is relieved by means of a second throttle having a smaller cross-section and which belongs to a working cylinder exerting a restoring action on the fuel quantity adjustment member of the injection device against the force of a spring, can be controlled by means of a control edge of the piston of the hydraulic servomotor.

According to another feature of the present invention a reference pressure is utilized which consists of the delivery pressure of a fuel pump supplying the injection device, with the fuel pressure being variable by means of a pressure control valve. The restoring force and reference pressure advantageously being equal and being regulatable by a single common control valve. As a result, the injected fuel quantity serves as the reference parameter, and thus the fuel-air mixture can be influenced by regulating the delivery pressure of the fuel pump relative to the adjustment of the servomotor or throttle valve.

Other advantageous features of the present invention will become apparent from the remaining disclosure.

Two embodiments of the present invention are represented in simplified form in the drawings and will be described in further detail hereinafter.

DESCRIPTION OF THE EXEMPLARY EMBODIMENTS

Figure 1:
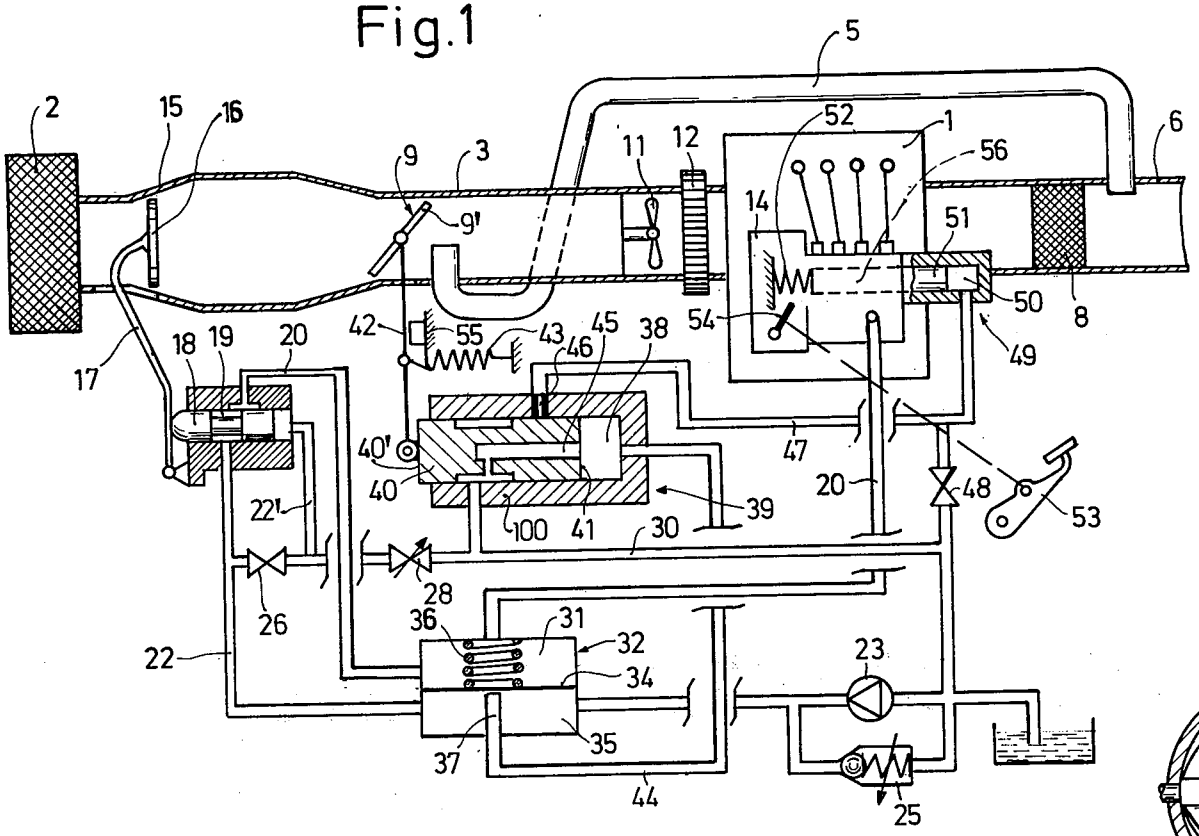
FIG. 1 is a schematic illustration of one embodiment of a fuel injection system for an internal combustion engine according to the present invention wherein exhaust gas recycling is utilized and including details illustrated partly in cross-section which in assembly serve to control the exhaust gas recycling.
Figure 3:
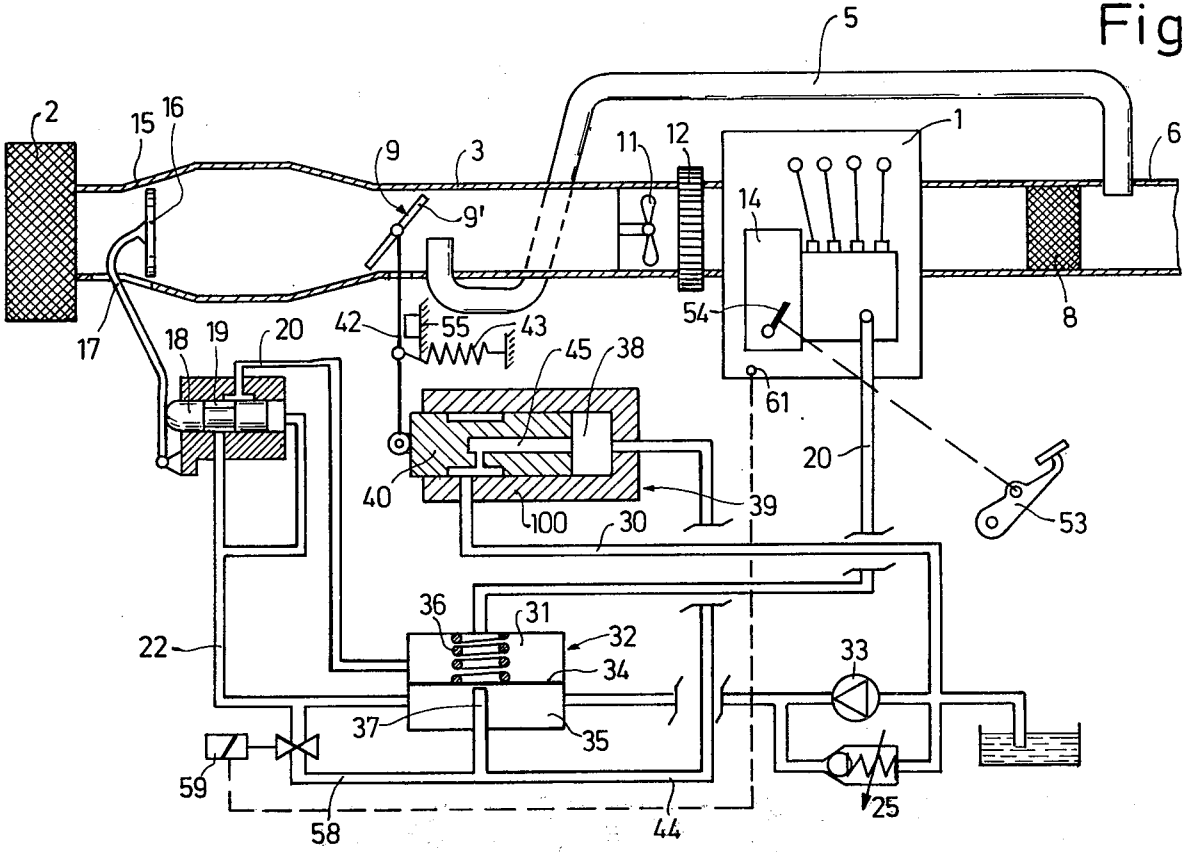
FIGS. 3 and 4 are schematic illustrations of further embodiments of the fuel injection system according to the present invention

In the embodiments shown in FIGS. 1 and 3, an engine 1, represented in simplified form, is supplied both with fresh air via a suction tube 3 and with an exhaust gas quantity admixed via an exhaust gas recycling line 5. At its mouth, the suction tube 3 is provided with an air filter 2. The exhaust gas recycling line 5 is connected to an exhaust pipe 6 of the engine and branches off from the exhaust pipe 6 downstream of a soot filter 8 inserted therein directly adjacent to the engine and discharges exhaust gas into the suction tube 3 at right angles to the direction of flow in the suction tube and downstream, and directly adjacent to a throttle valve 9. The discharge end of the recycling line 5 is formed as a nozzle extending as far as the center line of the suction tube 3. The nozzle end of the recycling line 5 is closeable by the half of the throttle valve 9 which is disposed downstream when the latter is in a 90° position, i.e., relative to its closed position. When the exhaust gas recycling line 5 is open, an exhaust gas flow is insured by the pressure difference between the suction side and the exhaust side of the engine resulting from the volume increase in the engine, i.e., a natural pressure gradient from the suction side to the exhaust side of the engine 1 is present, because, due to the suction within the suction tube 3, there always prevails a certain amount of negative gauge pressure, whereas the expulsion of exhaust gas always causes a certain amount of positive gauge pressure in the exhaust system. To further increase the pressure difference, a pressure increasing device in the form of a gas pump 11 and a cooling device 12 for the suction mixture can be provided in the suction tube 3 adjacent to the mouth of the exhaust gas recycling line 5. With or without the gas pump 11 and cooling device 12, the engine 1 is supplied with fuel by a series injection pump 14 which could equally well consist of a different injection device, for example, a distributor pump. A baffle plate 16 disposed at right angles to the direction of air flow is provided upstream of the throttle valve 9 in a conically expanded portion 15 of the suction tube 3. This baffle plate 16 is attached to a lever 17 as a part of the air metering element and is pivotable in this region of the suction tube 3 in opposition to a substantially constant hydraulic restoring force which is exerted on the lever 17 via a control slide 18. As a result of the displacement of the baffle plate 16, the control slide 18 is simultaneously displaced in its cylindrical bore in correspondence with the supplied quantity of fresh air and the cross-section formed by an annular groove 19 and a fuel suction line 20 branching off from the same, is varied. The annular groove 19 of the control slide 18 is continuously supplied with fuel from a fuel supply line 22 by a fuel pump 23. The pressure of the fuel supplied is kept constant by a pressure control valve 25. For the purpose of returning the control slide 18, a fuel line 22′ branches off from the fuel supply line 22 via an uncoupling throttle 26 is designed to limit the fuel flow. The return force on the rear side of the control slide 18 is regulatable at a fixed constant value by another regulatable throttle 28 located in a discharge line 30 on the suction side of the fuel pump 23.

The suction line 20 to the fuel injection pump 14 passes through the pressure chamber 31 of a differential pressure valve 32. This pressure chamber 31 is separated from a controlled pressure chamber 35 by a membrane 34 and is equipped with a pressure spring 36 acting on the membrane 34. The controlled pressure chamber 35 is disposed in the fuel supply line 22 and comprises an outflow opening 37 controlled by the membrane 34; this outflow opening 37 being in communication with the working chamber 38 of a hydraulic servomotor 39.

The hydraulic servomotor 39 consists of a piston 40 which is displaceable in a cylinder 100. The front side 40′ acts on a transmission rod 42, which in turn serves to adjust the throttle valve 9 in opposition to a spring 43.

A throttle channel 45, through which fuel is able to flow continuously to the discharge line 30, leads from a working chamber 38 of the cylinder 100 through the piston 40. A throttle bore 46 in the wall of the cylinder 100 leads from the working chamber 38 into a line 47. This throttle bore 46 is controlled by the other front side 41 of the piston 40 when the piston is in a position corresponding to the maximum opening angle of the throttle valve 9 and is connected to the working chamber 50 of a working cylinder 49 via the line 47. The line 47 is relieved via a second throttle 48 having a smaller cross-section than the bore 46. The piston 51 of the working cylinder 49 acts on a fuel quantity adjustment member 56 of the injection pump 14 against the force of a spring 52. In FIG. 1 this fuel quantity adjustment member consists, for example, of the regulating rod of a series injection pump. In the embodiments illustrated, fuel quantity adjustment of the injection pump is effected by means of a control lever 53, for example, of the vehicle, which is coupled to the control lever 54 for adjusting the regulating rod.

Figure 2:
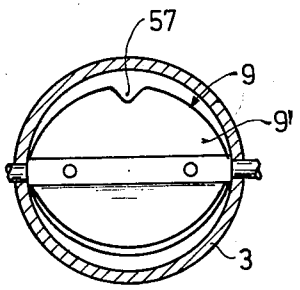
FIG. 2 is a cross-sectional view taken along the line 2—2 in FIG. 1.

An adjustable stop 55, with which the minimum opening angle of the throttle valve 9 is limited, is provided on the transmission rod 42 between the piston 40 of the servomotor 39 and the throttle valve 9. However, a minimum opening angle effect can also be obtained when the throttle valve 9 is closed by means of a recess 57 on the throttle valve 9, as shown in FIG. 2.

The fuel injection system illustrated in FIG. 1 operates in the following manner: when the lever 53 is actuated, the fuel quantity supplied to the engine 1 is, for example, increased, which results in the injection pump 14 drawing in a greater quantity of fuel via the fuel suction line 20. With an initially constant metering cross-section at the control slide 18, this causes a pressure reduction in the pressure chamber 31 of the differential pressure valve 32 such that the outflow opening 37 is opened by the constant reference pressure in the controlled pressure chamber 35 and more fuel is able to flow into the working chamber 38 to adjust the piston 40. By virtue of the displacement of the piston 40, which is thereby produced, an opening in the throttle valve 9 is produced and thus the quantity of fresh air drawn in by the engine is increased. This in turn causes deflection of the baffle plate 16. Owing to the deflection of the baffle plate 16 the control slide 18 is displaced, causing the metering cross-section to be increased and the original pressure in the fuel suction line 20 is again obtained. As a result, when the fuel injection quantity is varied, a correspondingly regulated fresh air quantity is supplied and the quantity of recycled exhaust gas in the drawn-in mixture is simultaneously reduced.

As the engine load increases, the throttle valve 9 is thus increasingly adjusted until it reaches the position of maximum adjustment with respect to the vertical position corresponding to full load operation. During full load operation the mouth of the exhaust gas recycling line 5 is closed by the throttle valve half section 9' such that only fresh air is drawn in by the engine. However, in this position the piston 40 of the servomotor 39 opens the throttle 46 with its front side 41 and communication between the working chamber 38 and the working chamber 50 of the working cylinder 49 is produced. As the throttle 48 has a smaller cross-section than the throttle 47, a pressure can build up in the working chamber 50 which seeks to displace the fuel quantity adjustment member 56 from the full load position in the direction of a reduced injection quantity. The injection quantity which is reduced thereby results in the throttle valve 9 being easily moved in the closing direction so that the full load quantity is thus limited according to the design of the air metering element.

Further adaptation of the mixture can be achieved by varying the angle of the conical part 15. Accordingly, this arrangement has the advantage that the correct quantity of fresh air and recycled exhaust gas can be regulated over the entire load range as a function of the injection quantity adjusted at the injection pump, and the full load quantity is determined by the air metering element independently of the delivery characteristic of the fuel injection pump.

The tension of the spring 43 is increased as the load increases, and during the same pressure variation the throttle valve 9 is opened by a smaller angular opening as the load increases and the air metering element is also readjusted in a similar manner. Accordingly, with this type of arrangement, as the load increases, the fuel-air mixture supplied to the engine becomes richer. According to the design of the spring 43 a load-dependent rectification of the drawn-in quantity of air is obtained in the form of a richer mixture during full load. Load dependent adaptation of the composition of the mixture can thus be obtained by virtue of the configuration of the spring 43 which can also consist of a spring bank with different spring rates.

If, on the other hand, the fuel injection quantity is continuously reduced by means of the control lever 53, the throttle valve 9 closes to a position which is determined by the adjustable stop 55. This prevents only recycled exhaust gas from being drawn in when the fuel injection quantity is suddenly increased until the throttle valve 9 opens in due order and admits fresh air. This measure prevents a burst of smoke from being produced when the fuel injection quantity is suddenly increased from zero load. The adjustable stop is so adjusted that control of the fresh air supply quantity or recycled exhaust gas quantity is obtained even in the lower load ranges above the idling rate.

The embodiment of FIG. 3 differs from the embodiment shown in FIG. 1 in that the restoring force on the rear side of the control slide 18 is equal to the reference pressure in the controlled pressure chamber 34 of the differential pressure valve 32, or respectively, in the fuel supply line 22. Accordingly, in this case, the reference pressure or restoring force is advantageously only adjusted at one point, i.e., at the pressure control valve 25. The adjustable throttle 28 shown in FIG. 1 in the connection to the relief line 30 and the throttle 26 can be eliminated. A venting throttle can be installed to ventilate the chamber above the control slide 18.

In the embodiment shown in FIG. 2, the influencing of the full load fuel injection quantity by means of the throttle bore 46 controlled by the piston 40 and the working cylinder 49 is eliminated. Instead, a line 58 is used to produce a connection between the fuel supply line 22 and the connecting line 44 leading from the outflow opening 37 to the working chamber 38 of the servomotor 39. A solenoid valve 59 is inserted in the line 58; this solenoid valve 59 being controlled, for example, by a temperature sensor 61, at the engine. The temperature sensor 61 measures, for example, the cooling water temperature of the engine and causes the solenoid valve 59 to be closed only when a minimum engine temperature has been reached. By virtue of this arrangement the solenoid valve 59 produces a connection between the fuel supply line 22 and the working chamber 38 of the servomotor 39 when the engine is still cold, such that the full pressure of the system acts on the piston 40 and the throttle valve is fully opened, while at the same time, the mouth of the exhaust gas recycling line 5 is completely closed. Only when a specific minimum engine temperature has been reached is the line 58 interrupted by the solenoid valve 59 such that regulation of the ratio of air to the exhaust gas recycling rate in accordance with the fuel injection quantity is controlled from this point onwards.

When the engine is still cold, directly after the internal combustion engine has been started, the engine does not rotate regularly. However, the irregular performance of the cold engine produces substantially more powerful pressure pulses on the exhaust side which advance through the exhaust gas recycling line 5 to the throttle valve 9 and cause the throttle valve to vibrate. By fully opening the throttle valve 9, and closing the exhaust gas recycling line 5 in the very short period between starting the engine and reaching a cooling water temperature of approximately + 30° C. harmful vibration of the throttle valve 9 and of the entire system is avoided and a more stable warm up of the engine is obtained.

Figure 4:
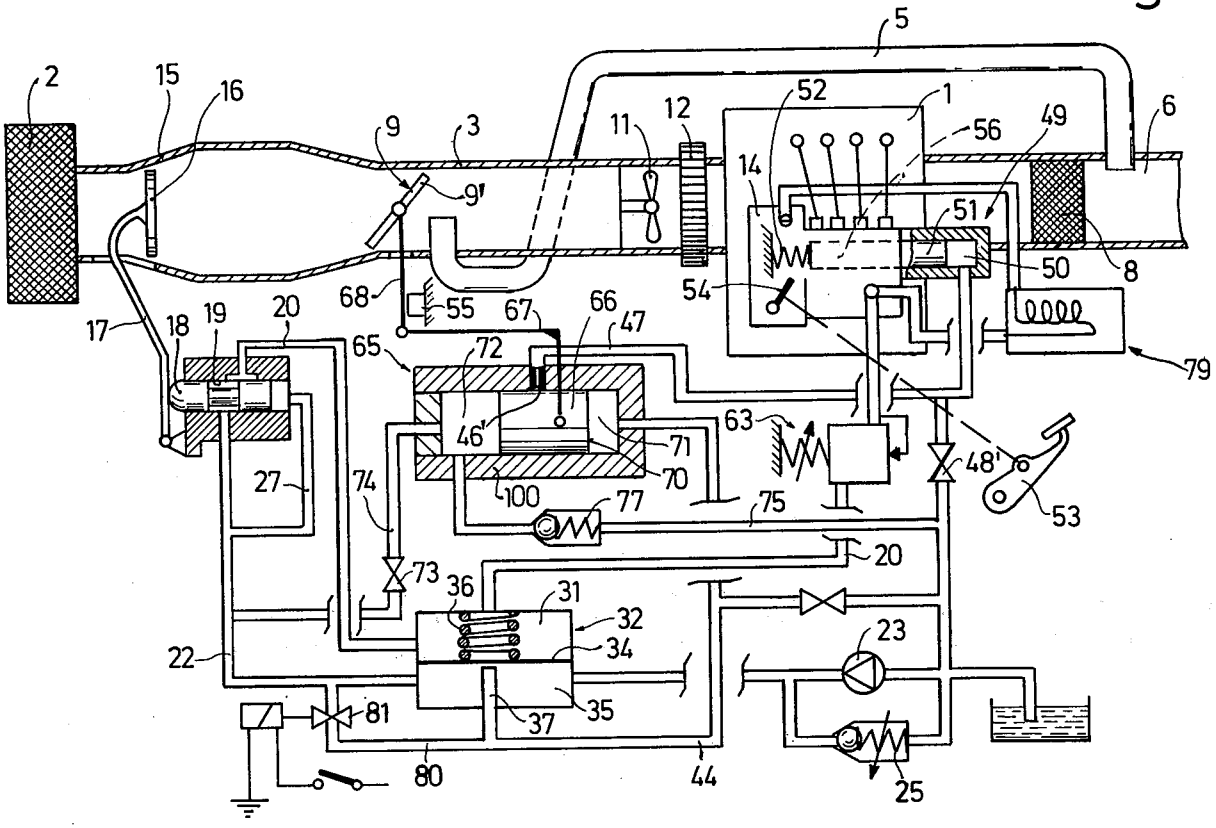

As in the embodiment shown in FIG. 1, in the third embodiment of FIG. 4 the suction tube 3 of the engine 1 contains a throttle valve 9 which is connected upstream of the air metering element 16, 17 in the conical part 5 of the suction tube. As in the first embodiment, the engine is supplied with fuel by an injection pump 14. The piston 51 of a working cylinder 49 acts on the fuel quantity adjustment member of the injection pump 14 against a spring 52. As in the first embodiment shown in FIG. 1, the injection pump 14 is supplied with a fuel by a fuel pump 23; the fuel being supplied under a pressure regulated by means of the pressure control valve 25 via the fuel supply line 22 and the fuel suction line 20 of the injection pump 14. The fuel supply line 22 passes through the control pressure chamber 35 of the differential pressure valve 32 into the annular groove 19 of the control slide 18 which, according to the air flow acting on the baffle plate 16, is displaced by the lever 17 against a constant hydraulic pressure acting on its rear side and, in so doing, it varies the outflow cross-section into the fuel suction line 20. The rear side of the control slide 18 communicates with the fuel supply line 22 via a connecting line 27. In this case the reference pressure and the restoring force are again engaged by the individual pressure control valve 25 as in the embodiment shown in FIG. 3.

As in the embodiment shown in FIG. 1, the uncontrolled pressure chamber 31 of the differential pressure valve 32 is again located in the fuel suction line 20. A pressure reduction valve 63 is also inserted in the fuel suction line 20 between the differential pressure valve 32 and the injection pump 14. The throttle valve 9 is adjusted by means of a servomotor 65 whose piston 66 contacts the throttle valve 9 by means of a rod 67 and a rod 68. The piston 66 is displaceable in a cylinder 100 of the servomotor 65, which in this embodiment is a closed cylinder. The cylinder 100 does have a slot (not shown) to accommodate the displacent of the rod 67. The working chamber 71 enclosed in this cylinder communicates with the controlled outflow opening 37 of the differential pressure valve 32 via the connection line 44. A connecting line 74, which is equipped with an uncoupling throttle 73, and which leads from the fuel supply line 22, discharges in the opposite working chamber 72 of the servomotor 65. A relief line 75 leads from the working chamber 72 to the suction side of the fuel pump 23. The restoring fuel pressure in the working chamber 72 is engaged by a pressure control valve 77 in the relief line 75. A throttle bore 46 leading from the working chamber 71 is also controllable by the front face 70 of the working piston 66 in the end position of the piston corresponding to the fully opened position of the throttle valve 9. From the throttle bore 46 the line 47 leads to the working chamber 50 of the working cylinder 49 of the injection pump 14. As in the first embodiment, the working chamber 50 is relieved to the pump suction side of the fuel pump 23 through a connection via a second throttle 48 which has a smaller cross-section than the throttle bore 46'.

As in the embodiment shown in FIG. 1, the rod 68 is also equipped with an adjustable stop 55, with which a specific minimum closing position of the throttle valve 9 can be engaged.

A cooling device 79 for the fuel quantity flowing to the fuel injection pump 14 is also provided; this fuel quantity flowing directly back to the suction side of the injection pump 14.

The fuel supply line 22, together with a connecting line 80, in which an arbitrarily actuatable solenoid valve 81 is disposed, is connectable with the connecting line 44 and thus the working chamber 71 of the servomotor 65.

The mode of operation of the system shown in FIG. 4 corresponds substantially to that of the preceding examples. By virtue of the common pressure control valve 25, a constant pressure is obtained which serves both as the reference pressure in the differential pressure valve 32 and also as the restoring pressure at the control slide 18. Contrary to the embodiment shown in FIGS. 1 and 3, in this case the piston 66 of the servomotor 65 is displaced against the constant hydraulic force in the working chamber 72. The constant restoring force is produced by a hydraulic pressure which is regulatable by the pressure control valve 77 in the working chamber 72 of the servomotor 65. As a result of this arrangement the air-fuel ratio is independent of the throttle valve position. In the same manner as in the embodiment shown in FIG. 1, in a full load position, corresponding to a fully opened throttle valve 9, a connection is produced in this case between the working chamber 71 and the working chamber 50 of the working cylinder 49 such that the fuel quantity adjustment member of the injection pump 14 is displaced against the force of the spring 52 in the direction of a reduced fuel quantity which results in the outflow cross-section of the outflow opening 37 in the differential pressure valve being reduced because the pressure in the pressure chamber 31 has risen. This reduction results in a reduction in the pressure in the working chamber 71 of the servomotor 65 and displacement of the piston 66 in the closing direction of the throttle valve 9 until pressure compensation is again restored.

By incorporating the pressure reduction valve 63 in the suction line 20 between the differential pressure valve 32 and the injection pump 14, it is possible to operate with a pressure which is higher than the suction pressure of the suction pressure of the injection pump 14 which simultaneously brings an increase in the servo force produced by the servomotor 65. The increase in the servo force results in reliable rapid actuation and a reduction in the vibration tendency of the throttle valve 9 during pulse bursts from the engine via the exhaust gas recycling line, particularly at low speed and with a low load, for example, during idling and warm up. To avoid having to use injection pumps with stronger seals, owing to the resulting higher pressure in the fuel suction line 20, the pressure reducing valve 63 was therefore provided in the fuel suction line.

The pump can also be cooled by means of the cooler 79 to avoid adulteration of the oncoming fuel quantity by the differential pressure valve 32; the fuel quantity flowing therethrough being recycled directly to the suction line 20 of the injection pump 14.

In all the embodiments the soot filter 8 is advantageously inserted in the exhaust line 6 immediately after the exhaust gas discharge from the engine. This soot filter advantageously consists of a corrosion-resistant high-grade steel wool and it filters any possible soot particles from the exhaust gas before a portion of the same is again supplied to the engine via the exhaust gas recycling line 5. By using this type of soot filter, for example, fine-grade steel wool, soot components from the exhaust gas are filtered out at low temperatures. At temperatures in excess of 500° C the soot particles are burnt from the filter, thus eliminating the need to clean the filter. Temperatures in excess of 500° C, which only occur when a diesel engine is operated in the high load ranges, are obtained in substantially lower load ranges by virtue of the exhaust gas recycling system. Pollution in the suction system of the engine by the recycling exhaust gas is thus avoided.

The servomotor 65 which, together with the air metering element, simultaneously limits the full load fuel injection quantity can advantageously also be used as a shut-off member when the working chamber 71 of the servomotor is exposed to the full pressure in the fuel supply line 22 via the solenoid valve 81. By opening the valve, the piston 66 is displaced to the left, the throttle bore 46' is opened and the piston 51 together with the quantity adjustment member of the injection pump 14 is displaced in the direction of a zero quantity. There is no return regulation in this case as the pressure in the working chamber 71 is no longer regulated but has reached the maximum pressure.

What is claimed is:

1. A fuel injection system for an internal combustion engine, comprising in combination:

a. a suction tube through which an air flow is established;

b. an exhaust gas line through which an exhaust gas flow is established;

c. an exhaust gas recycling line connected to the exhaust gas line and to the suction tube, the suction tube connection defining therein a discharge outlet of the recycling line;

d. a throttle valve controlling the flow of the exhaust gas in the recycling line, said throttle valve being mounted within the suction tube upstream of and in operative association with the discharge outlet of the recycling line;

e. air metering means mounted to partially extend into said suction tube and be displaceable by the air flow thereon;

f. fuel injection means including means for arbitrarily varying the fuel quantity delivered by the fuel injection means;

g. a servomotor including a displaceably mounted piston, a working chamber and means connecting the piston to the throttle valve for controlling the opening thereof;

h. means providing a variable restoring force against the displacements of the servomotor piston;

i. a differential pressure valve having an uncontrolled pressure chamber, a controlled outflow opening in a chamber having an essentially constant reference pressure, and means connecting the controlled outflow opening to the working chamber of the servomotor;

j. fuel metering means including a control slide connected to and displaceable by the air metering means, a throttle whose cross-section is varied by the displacements of the control slide, and means for establishing a regulatable, substantially constant return force acting against the displacements of the control slide; and k. a fuel suction line connected to the fuel injection means, the uncontrolled pressure chamber of the differential pressure valve and, upstream of its connection to the uncontrolled pressure chamber, to the throttle whose cross-section is varied, wherein:

i. the arbitrarily varied fuel quantity serves as a reference parameter for the operation of the servomotor; and ii. the servomotor piston is displaceable, against the variable restoring force, between two positions, one corresponding to a fully opened position of the throttle valve and closed exhaust gas recycling line, and the other corresponding to a substantially closed throttle valve.

2. The fuel injection system as defined in claim 1, further comprising an adjustable stop, wherein, the substantially closed position of the throttle valve can be determined by the adjustable stop.

3. The fuel injection system as defined in claim 1, wherein the throttle valve includes a recess as a minimum throughput cross-section.

4. The fuel injection system as defined in claim 1, wherein a spring arrangement comprising at least one spring having a defined force characteristic serves as the restoring force means.

5. The fuel injection system as defined in claim 1, wherein an adjustable constant hydraulic force constitutes the restoring force.

6. The fuel injection system as defined in claim 1, further comprising:

l. a fuel supply line exposed to differential pressure;

m. an engine temperature sensor;

n. a solenoid valve connected to the sensor;

o. a connecting line connected between the means connecting the controlled outflow opening to the working chamber of the servomotor and the fuel supply line, wherein the solenoid valve closes, via the connecting line, the means connecting the controlled outflow opening to the working chamber of the servomotor and the fuel supply line upon the sensor sensing a given temperature limit.

7. The fuel injection system as defined in claim 1, wherein the fuel injection means includes a working cylinder defining a working chamber, a fuel quantity adjustment member and a spring, wherein the servomotor piston defines a control edge, and wherein the fuel injection system further comprises:

l. throttle means connected to the servomotor for communicating with the working chamber of the servomotor, said throttle means being controlled by the control edge of the servomotor;

m. means connecting the throttle means to the working chamber defined by the working cylinder; and n. further throttle means connected to said means defined in (m) above, said further throttle means having a smaller cross-section than said throttle means and serving to relieve the working chamber defined by said working cylinder, said working cylinder serving to produce a restoring action on the fuel quantity adjustment member in opposition to the force exerted by said spring.

8. The fuel injection system as defined in claim 7, further comprising:

o. a fuel supply line exposed to a reference pressure;

p. a solenoid valve;

q. a connecting line connected between the means connecting the controlled outflow opening to the working chamber of the servomotor and the fuel supply line, wherein the solenoid valve arbitrarily closes, via the connecting line, the means connecting the controlled outflow opening to the working chamber of the servomotor and the fuel supply line.

9. The fuel injection system as defined in claim 1, further comprising a fuel supply pump and a pressure control valve, wherein a reference pressure is established which comprises the delivery pressure of the fuel supply pump, or wherein said delivery pressure is regulatable by the pressure control valve.

10. The fuel injection system as defined in claim 9, wherein the restoring pressure and the reference pressure are equal and are regulatable by the pressure control valve.

11. The fuel injection system as defined in claim 9, further comprising a pressure reducing valve disposed in the fuel suction line between the differential pressure valve and the fuel injection means.

12. The fuel injection system as defined in claim 11, wherein the suction tube includes a conical portion, and wherein the air metering means includes a low friction pivot arm and a pivotable baffle plate mounted on the pivot arm in the conical portion of the suction tube.

13. The fuel injection system as defined in claim 1, further comprising a fine steel wool soot filter insert in the exhaust pipe, wherein the exhaust gas recycling line branches off downstream of said filter.

14. The fuel injection system as defined in claim 1, wherein the fuel injection means includes an injection pump and a heat exchanger in a short circuit line, via which the fuel quantity flowing to the injection pump can be recycled to the suction side input of the injection pump.

15. The fuel injection system as defined in claim 1, further comprising a gas pump disposed in the suction tube adjacent to the discharge of the exhaust gas recycling line.

16. The fuel injection system as defined in claim 1, further comprising a cooling device disposed in the suction tube adjacent to the discharge point of the exhaust gas recycling line.

* * * * *